US009867241B2

(12) United States Patent
Yeh et al.

(10) Patent No.: US 9,867,241 B2
(45) Date of Patent: Jan. 9, 2018

(54) DIMMING MODULE AND SOLID STATE LIGHTING DEVICE

(71) Applicant: Lextar Electronics Corporation, Hsinchu (TW)

(72) Inventors: Chien-Nan Yeh, Kaohsiung (TW); Chun-Jong Chang, Hsinchu County (TW); Po-Shen Chen, Hsinchu (TW); Kai-Hsiang Shih, Changhua County (TW); Jhao-Cyuan Huang, New Taipei (TW); Ku-Cheng Lin, Taoyuan (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 15/361,481

(22) Filed: Nov. 27, 2016

(65) Prior Publication Data

US 2017/0223793 A1 Aug. 3, 2017

(30) Foreign Application Priority Data

Feb. 2, 2016 (TW) ..... 105103318 A

(51) Int. Cl.
*H05B 37/02* (2006.01)
*H05B 33/08* (2006.01)

(52) U.S. Cl.
CPC ..... *H05B 33/0818* (2013.01); *H05B 33/083* (2013.01); *H05B 33/0827* (2013.01); *H05B 33/0857* (2013.01)

(58) Field of Classification Search
CPC ..... H05B 33/0815; H05B 33/0845; H05B 41/3927
USPC ..... 315/186
See application file for complete search history.

(56) References Cited

U.S. PATENT DOCUMENTS

| | | | | |
|---|---|---|---|---|
| 7,759,881 | B1 * | 7/2010 | Melanson | H05B 33/0815 315/224 |
| 8,018,171 | B1 * | 9/2011 | Melanson | H05B 33/0815 315/194 |
| 8,638,045 | B2 * | 1/2014 | Kunst | H05B 33/0815 315/185 S |
| 2008/0224629 | A1 * | 9/2008 | Melanson | H05B 33/0815 315/247 |

(Continued)

FOREIGN PATENT DOCUMENTS

| | | |
|---|---|---|
| CN | 104853479 A | 8/2015 |
| TW | 201233233 A1 | 8/2012 |

(Continued)

*Primary Examiner* — Don Le
(74) *Attorney, Agent, or Firm* — CKC & Partners Co., Ltd.

(57) ABSTRACT

A dimming module and a solid state lighting device are shown. The dimming module includes a rectifying circuit, a first driving circuit, and a processing circuit. The rectifying circuit is configured to convert an AC voltage to a rectified voltage. The first driving circuit is configured to receive the rectified voltage to provide a first current so as to drive a first lighting module. The first driving circuit includes a first switch. The first switch turns ON or OFF selectively according to a first control voltage signal so as to control the first current. The processing circuit is configured to receive a dimming command, and adjust the first control voltage signal according to the dimming command. The first control voltage signal is configured to control a phase delay angle and a duty cycle of the first current.

8 Claims, 7 Drawing Sheets

(56) References Cited

U.S. PATENT DOCUMENTS

| | | | | |
|---|---|---|---|---|
| 2011/0285301 | A1* | 11/2011 | Kuang | H05B 33/0845<br>315/200 R |
| 2016/0234893 | A1* | 8/2016 | Nishizono | H05B 33/0815 |

FOREIGN PATENT DOCUMENTS

| | | | |
|---|---|---|---|
| TW | M500858 | U | 5/2015 |
| TW | M515250 | U | 1/2016 |
| TW | 201605290 | A | 2/2016 |

* cited by examiner

DIMMING MODULE AND SOLID STATE LIGHTING DEVICE

RELATED APPLICATIONS

This application claims priority to Taiwan Application Serial Number 105103318, filed Feb. 2, 2016, which is herein incorporated by reference.

BACKGROUND

Technical Field

The present disclosure relates to a dimming module and a solid state lighting device, particularly, to the dimming module and the solid state lighting device with adjustable color temperature.

Description of Related Art

In recent times, due to the advantages of light-emitting diodes, such as high efficiency, and energy saving abilities, light-emitting diodes (LEDs) have replaced traditional lighting sources in many applications and have become an important area of research.

However, when dimming the brightness and the color temperature of the existing solid state lighting device using LEDs, two or more sets of phase-cut dimmer are required to control the brightness and the color temperature separately. In addition, the problems such as instability and/or undesired flickering occur when traditional phase-cut dimmers are used to provide the dimming control of the LEDs. Accordingly, ways in which to simplify the adjustment of the brightness and the color temperature for solid state light source devices and to improve the stability of the dimming control are important research issues and urgent objects in the relevant field.

SUMMARY

An aspect of the present disclosure is a dimming module. The dimming module includes a rectifying circuit, a first driving circuit, and a processing circuit. The rectifying circuit is configured to convert an AC voltage to a rectified voltage. The first driving circuit is configured to receive the rectified voltage to provide a first current to drive a first lighting module. The first driving circuit includes a first switch, which is configured to be on or off according to a first control voltage signal selectively to control the first current. The processing circuit is configured to receive a dimming command and adjust the first control voltage signal according to the dimming command. The first control voltage signal is configured to control a phase delay angle of the first current and a duty cycle of the first current.

Another aspect of the present disclosure is a solid state lighting device. The solid state lighting device includes a first lighting module, a second lighting module, a first driving circuit, a second driving circuit and a processing circuit. The first lighting module includes a first color temperature. The second lighting module includes a second color temperature different from the first color temperature. The first driving circuit is configured to provide a first current to drive the first lighting module according to a first control voltage signal. The first current is configured to control a first luminosity of the first lighting module. The second driving circuit is configured to provide a second current to drive the second lighting module according to a second control voltage signal. The second current is configured to control a second luminosity of the second lighting module. The processing circuit is configured to receive a dimming command and adjust the first control voltage signal and the second control voltage signal according to the dimming command. When the first luminosity and the second luminosity are configured to be larger than a critical luminosity value, the first control voltage signal and the second control voltage signal are configured to control a phase delay angle of the first current and of the second current respectively to adjust the first luminosity and the second luminosity.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
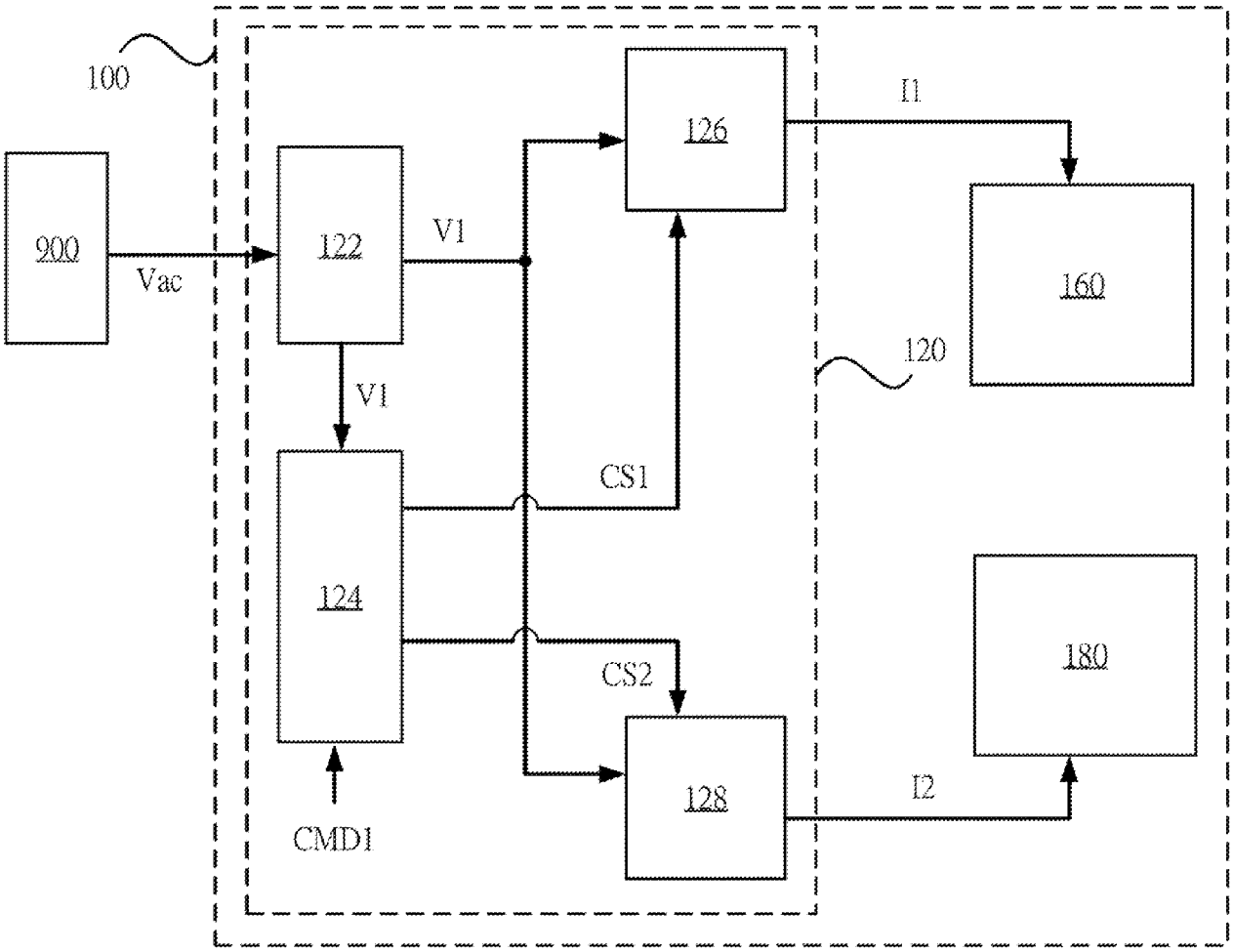
FIG. 1 is a schematic diagram illustrating a solid state lighting device according to some embodiments of the present disclosure.

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. It is noted that, in accordance with the standard practice in the industry, the drawings are only used for understanding and are not drawn to scale. Hence, the drawings are not meant to limit the actual embodiments of the present disclosure. In fact, the dimensions of the various features may be arbitrarily increased or reduced for clarity of discussion. Wherever possible, the same reference numbers are used in the drawings and the description to refer to the same or like parts for better understanding.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

In addition, in the following description and in the claims, the terms "include" and "comprise" are used in an open-ended fashion, and thus should be interpreted to mean "include, but not limited to." As used herein, the term "and/or" includes any and all combinations of one or more of the associated listed items.

In this document, the term "coupled" may also be termed "electrically coupled," and the term "connected" may be termed "electrically connected," "Coupled" and "connected" may also be used to indicate that two or more elements cooperate or interact with each other. It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments.

Reference is made to FIG. 1. FIG. 1 is a schematic diagram illustrating a solid state lighting device 100 according to some embodiments of the present disclosure. As shown in FIG. 1, the solid state lighting device 100 includes a lighting module 160, a lighting module 180, and a dimming module 120 configured to adjust the luminosity of the lighting module 160 and the lighting module 180. In some embodiments, the dimming module 120 includes a rectifying circuit 122, a processing circuit 124, a driving circuit 126 and a driving circuit 128.

In some embodiments, an AC power source 900 provides an input AC voltage Vac as the electricity supply of the solid state lighting device 100. The rectifying circuit 122 receives the input AC voltage Vac from the AC power source 900 and performs rectification to convert the input AC voltage Vac to a rectified voltage V1 to the processing circuit 124, the driving circuit 126 and the driving circuit 128. The processing circuit 124 receives a dimming command CMD1 and respectively outputs control voltage signals CS1 and CS2 to the driving circuit 126 and the driving circuit 128 according to the dimming command CMD1. The driving circuit 126 and the driving circuit 128 control the current I1 and I2 of the lighting module 160 and the lighting module 180 respectively after receiving the control voltage signals CS1 and CS2, in order to adjust the luminosity of each of the lighting module 160 and the lighting module 180.

Therefore, if the lighting module 160 and the lighting module 180 have different color temperatures, the brightness and the color temperature of the solid state lighting device 100 may be correspondingly controlled by adjusting the amplitude of the current I1 and I2 and the ratio between the current I1 and I2. In the following paragraphs, the specific circuit details will be explained with accompanying figures.

Figure 2:
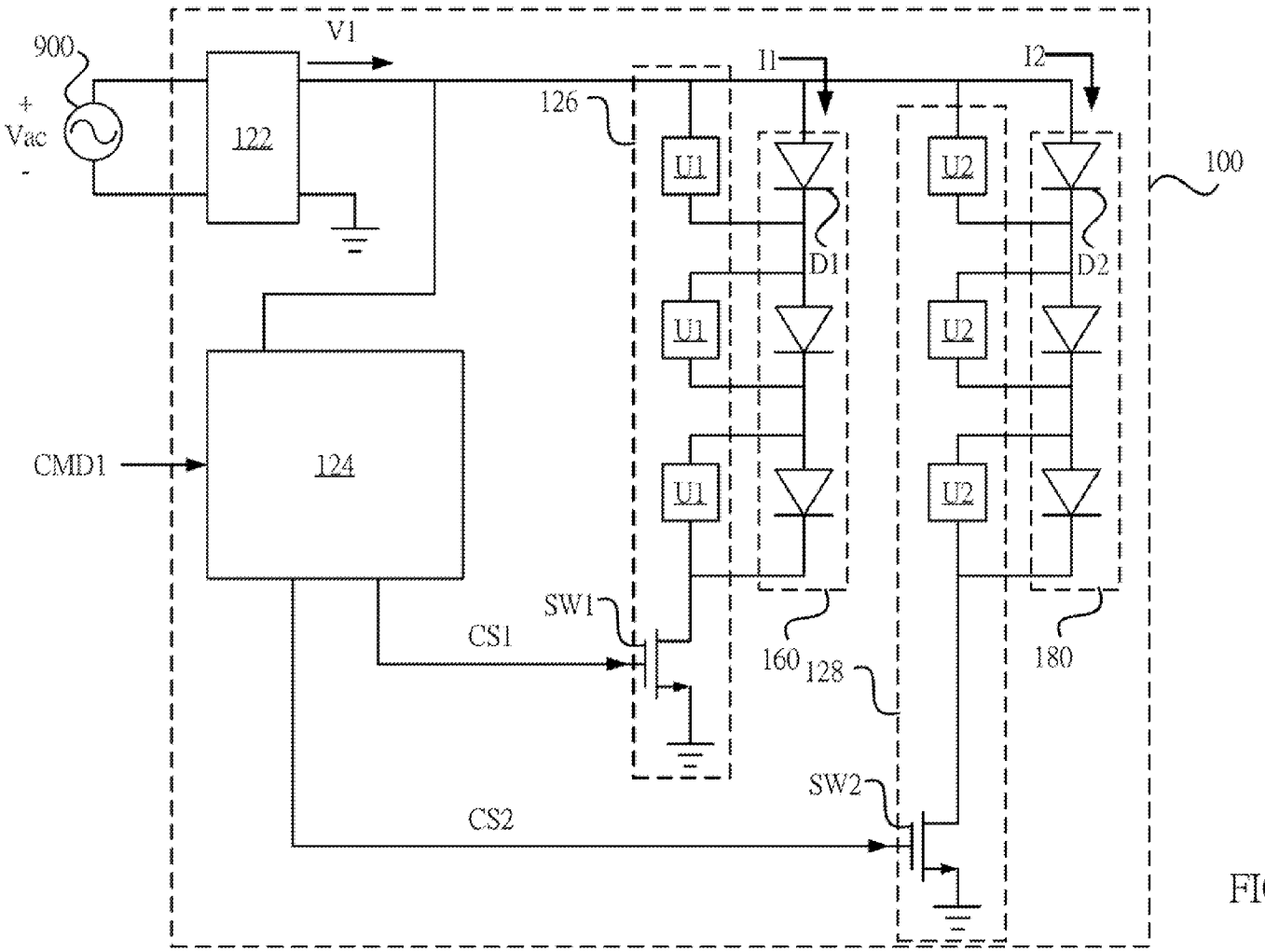
FIG. 2 is a schematic diagram illustrating the solid state lighting device according to some embodiments of the present disclosure.

Reference is made to FIG. 2. FIG. 2 is a schematic diagram illustrating the solid state lighting device 100 according to some embodiments of the present disclosure. As shown in FIG. 2, the rectifying circuit 122 is electrically coupled to the AC power source 900. The rectifying circuit 122 receives the input AC voltage Vac from the AC power source 900 and performs rectification to convert the input AC voltage Vac to the rectified voltage signal V1 For example, the rectifying circuit 122 may be implemented by a bridge rectifier including multiple diodes. It is noted that the rectifying circuit 122 may be realized in various ways and the rectifying circuit 122 in the present disclosure is not limited to the bridge rectifier. In addition, in some embodiments, the rectifying circuit 122 may further step down the input AC voltage Vac to output the rectified voltage with proper voltage level to supply power to the later stage circuits.

Reference is made to FIG. 2. The processing circuit 124 is electrically coupled to the rectifying circuit 122 and configured to receive the rectified voltage signal V1 from the rectifying circuit 122. In addition, the processing circuit 124 also receives the dimming command CMD1 from the external. Specifically, in some embodiments, the dimming command CMD1 may be a remote signal output from a remote controller. In some other embodiments, the dimming command CMD1 may be a wall-control signal output from a wall controller located on the wall. No matter the dimming command CMD1 is a remote signal or a wall-control signal, it may be received by a corresponding signal receiving unit and transmitted to the processing circuit 124 for the following dimming operations performed by the solid state lighting device 100. In addition, in some embodiments, the dimming command CMD1 may include the dimming instruction of adjusting the brightness of the light output from the solid state lighting device 100, and the dimming instruction of adjusting the color temperature of the light output from the solid state lighting device 100, but the present disclosure is not limited thereto. For example, in some embodiments, the dimming command CMD1 may also include various types of dimming instructions such as a time setting of switch or lighting mode selections.

After receiving the dimming command CMD1 from the external, the processing circuit 124 may correspondingly output the control voltage signals CS1 and CS2 according to the rectified voltage signal V1 and the dimming command CMD1. Alternatively stated, the processing circuit 124 may adjust and output corresponding control voltage signals CS1 and CS2 to achieve dimming for the brightness control command or the color temperature control command according to the dimming command CMD1. Specifically, the control voltage signal CS1 is configured to control the phase delay angle of the current I1 flowing through the lighting module 160 and the duty cycle of the current I1. The control voltage signal CS2 is configured to control the phase delay angle of the current I2 flowing through the lighting module 180 and the duty cycle of the current I2.

In some embodiments, the processing circuit 124 includes a zero-crossing detecting unit (not shown). The zero-crossing detecting unit is electrically coupled to the rectified circuit 122. The zero-crossing detecting unit is configured to detect the zero-crossing point of the rectified voltage V1, such that the control voltage signals CS1 and CS2 output by the processing circuit 124 is synchronized with the rectified voltage V1. Therefore, in each cycle, the processing circuit 124 may respectively control the phase delay angle of the current I1 and I2, which are generated corresponding to the rectified voltage V1 and flowing through the lighting modules 160 and 180, by the control voltage signals CS1 and CS2, and thus avoid the flickering of the output light resulted from the frequency differences or the phase differences between the control voltage signals CS1, CS2 and the input AC voltage Vac or the rectified voltage V1.

As shown in the figure, in some embodiments, the driving circuits 126 and 128 are electrically coupled to the rectifying circuit 122. The rectifying circuit 122 is configured to output the rectified voltage signal V1 to the driving circuits 126 and 128, to supply power to the lighting modules 160 and 180. It is noted that, in some embodiments, the electricity source of the driving circuits 126 and 128 for driving the lighting module 160 and the lighting module 180 may be independent from the rectified voltage signal V1, so the present disclosure is not limited to the embodiments shown in FIG. 2.

The driving circuits 126 and 128 receive the control voltage signals CS1 and CS2 respectively, and drive the lighting module 160 and the lighting module 180 in the solid state lighting device 100 respectively according to the control voltage signals CS1 and CS2. Specifically, as shown in FIG. 2, in some embodiments, the driving circuit 126 includes a switch SW1 and multiple driving units U1 electrically coupled in series to each other, in which the driving units U1 correspond to multiple light emitting diodes D1 electrically coupled in series to each other in the lighting module 160.

A first terminal of the switch SW1 is electrically coupled to the driving unit U1, and a second terminal of the switch. SW1 is electrically coupled to a ground terminal, and a control terminal of the switch SW1 is electrically coupled to the processing circuit 124 and configured to receive the control voltage signal CS1 to drive the lighting module 160. When the control voltage signal CS1 is at a first level (e.g., high level), the switch SW1 is turned ON such that the current I1 flows through the light emitting diodes D1 in the lighting module 160. On the other hand, when the control voltage signal CS1 is at a second level (e.g., low level), the switch SW1 is turned OFF such that the current flowing through the light emitting diodes D1 in the lighting module 160 is zero. Alternatively stated, the switch SW1 is selectively turned ON or OFF according to the control voltage signal CS1 to control the current I1 flowing through the lighting module 160. Therefore, by properly controlling the duty cycle of the control voltage signal CS1, the amplitude of the current I1 may be controlled and thus the luminosity of the lighting module 160 is further controlled.

Similar to the driving module 126, the driving module 128 includes a switch SW2 and multiple driving units U2 electrically coupled in series to each other, in which the driving units U2 correspond to multiple light emitting diodes D2 electrically coupled in series to each other in the lighting module 180.

A first terminal of the switch SW2 is electrically coupled to the driving unit U2, and a second terminal of the switch. SW2 is electrically coupled to a ground terminal, and a control terminal of the switch SW2 is electrically coupled to the processing circuit 124 and configured to receive the control voltage signal CS2 to drive the lighting module 180. Therefore, by properly controlling the duty cycle or the voltage level of the control voltage signal CS2, the amplitude of the current I2 may be controlled and thus the luminosity of the lighting module 180 is further controlled. The detailed operation of the driving unit 128 is similar to the operation of the driving unit 126, and thus further explanations are omitted herein for the sake of brevity.

For the ease of explanation, in the following paragraphs, the operation of the control voltage signals CS1 and CS2 controlling the phase delay angle and the duty cycle of the current I1 and I2 flowing through the lighting modules 160 and 180 will be discussed in accompanied with FIGS. 3A-3D. Reference is made to FIGS. 3A-3D. FIGS. 3A-3D are waveform diagrams illustrating the relationship of the current I1 and the control voltage signal CS1 according to some embodiments of the present disclosure. It is noted that, waveform diagrams of the current I2 flowing through the lighting module 180 and the control voltage signal CS2 are similar to the waveform diagrams of the current I1 and the control voltage signal CS1, and thus are omitted herein for the sake of brevity.

As shown in FIGS. 3A-3D, when the control voltage signal CS1 is at the low level, the switch SW1 is turned OFF such that the current I1 is zero, and when the control voltage signal CS1 is at the high level, the switch SW1 is turned ON such that the current I1 is proportional to the rectified voltage V1. Since the rectified voltage V1 is obtained by performing a full-wave rectification to the input AC voltage Vac, the rectified voltage V1 is the upper half of the sinusoidal wave in each cycle.

Figure 3A:
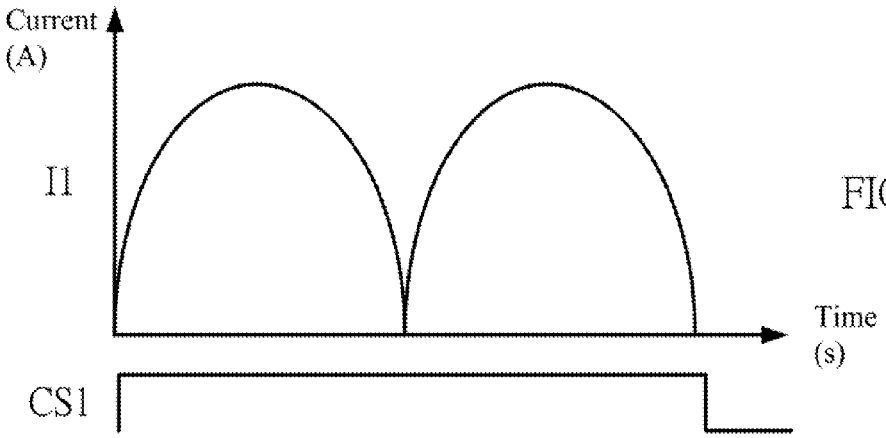
FIGS. 3A-3D are waveform diagrams illustrating the relationship of the current and the control voltage signal according to some embodiments of the present disclosure.
Figure 3B:
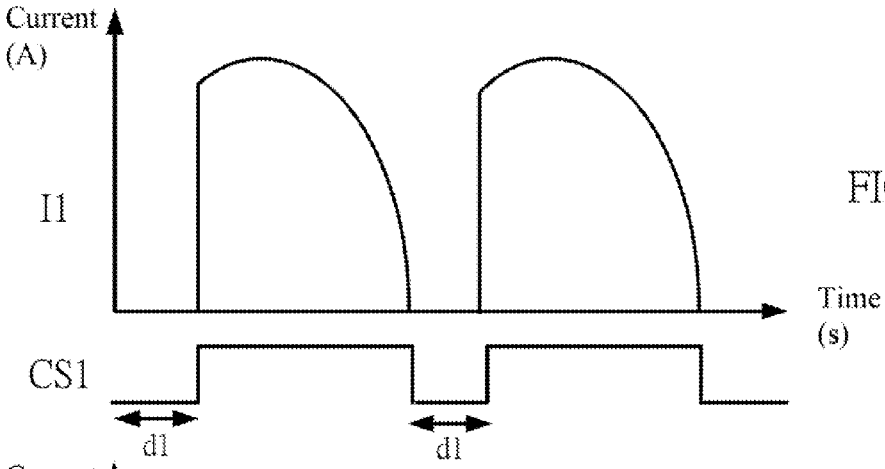
Figure 3C:
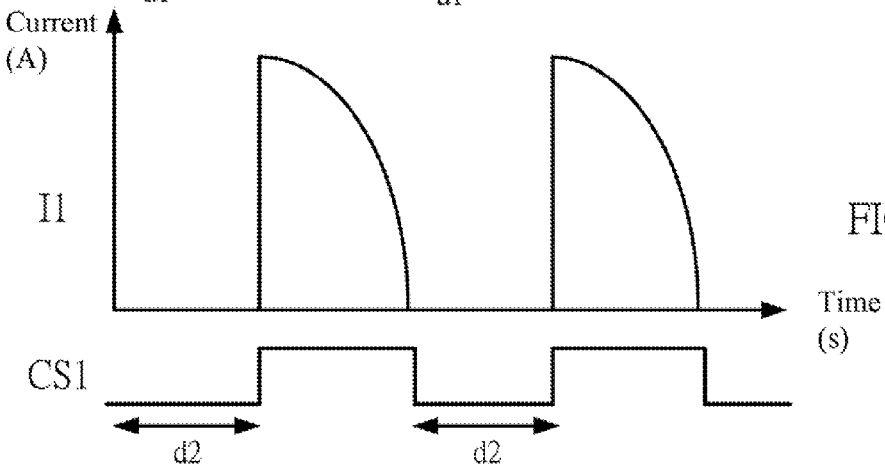

As shown in FIG. 3A, when the control voltage signal CS1 is ON continuously, the waveform of the current I1 is the upper half of the sinusoidal wave in each cycle. In this situation, the current I1 has the largest average value. As shown in FIGS. 3B and 3C, when the control voltage signal CS1 is ON after a phase delay angle d1 in each cycle, the current I1 flowing through the lighting module 160 has the corresponding phase delay angle d1. By properly controlling the value of the phase delay angle d1, the average value of the current I1 may be adjusted, and the luminosity of the lighting module 160 is further adjusted. For example, in some embodiments, as shown in FIG. 3B, when the control voltage signal CS1 is ON after the phase delay angle d1, the average value of the current I1 is about 75% of the largest average value. As shown in FIG. 3C, when the control voltage signal CS1 is ON after the phase delay angle d2 (e.g., about 90 degrees), the average value of the current I1 is about 50% of the largest average value. Alternatively stated, when the control voltage signal CS1 delays the phase delay angle d2, the switch SW1 is ON in half time and is OFF in the other half in a complete cycle, and thus the average value is half of the largest average value.

Figure 3D:
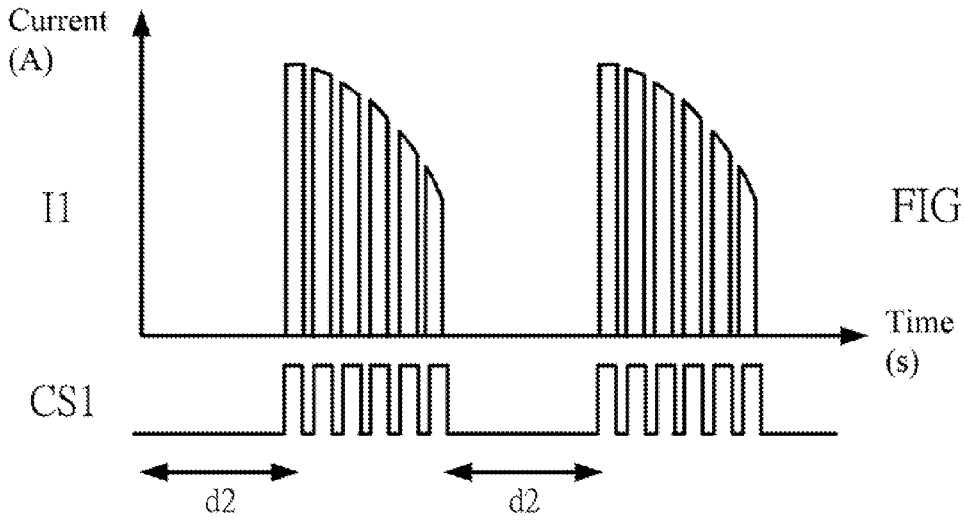

As shown in FIG. 3D, in some embodiments, to prevent the phase delay angle being too large and resulting in unstable characteristics of the supplying current, the control voltage signal CS1 may be fixed at the phase delay angle d2, and adjust the duty cycle of the control voltage signal CS1 in the turned-on period, so as to further reduce the average value of the current I1 with pulse width modulation (PWM). For example, in FIG. 3D, the control voltage signal CS1 is turned ON after delaying the phase delay angle d2 (e.g., about 90 degrees), and keep the duty cycle at about 50%. Therefore, in a complete cycle, only a quarter of the time the switch SW1 is turned ON and thus the average value is 25% of the largest average value. It is noted that, the duty cycle shown in the FIG. 3D is merely for the exemplary purpose and not meant to limit the present disclosure. In some embodiments, the duty cycle of the control voltage signal CS1 may be adjusted by the processing circuit 124 so as to control the average value of the current I1.

Alternatively stated, when the luminosity of the lighting module 160 is configured to be larger than a critical luminosity value, the control voltage signal CS1 is configured to control the phase delay angle of the current I1 to adjust the luminosity of the lighting module 160 by adjusting the average value of the current I1 When the luminosity of the lighting module 160 is configured to be smaller than the critical luminosity value, the control voltage signal CS1 is configured to control the phase delay angle fixed at a critical angle (e.g., about 90 degrees) and the duty cycle of the control voltage signal CS1 is controlled to adjust the luminosity of the lighting module 160 by adjusting the average value of the current I1.

It is noted that although the critical angle is configured to 90 degrees, but it is merely for the exemplary purpose and not meant to limit the present disclosure. In various embodiments, the critical angle of the phase delay angle or the critical luminosity value may be adjusted based on practical needs.

Therefore, the processing circuit 124 may output the control voltage signals CS1 and CS2 to the driving circuits 126 and 128 to adjust the current I1 and I2 respectively, and thus adjust the brightness and the color temperature of the light output by the solid state lighting device 100.

Specifically, in some embodiments, the lighting module 160 and the lighting module 180 may have different color temperatures. For example, the color temperature of the lighting module 160 may be a warm color temperature, such as about 3000K, and the color temperature of the lighting module 180 may be a cold color temperature, such as about 6000K, but the present disclosure is not limited thereto. One skilled in the art may choose various LEDs to design the lighting module 160 and the lighting module 180 with different color temperatures respectively based on practical needs.

Therefore, the processing circuit 124 may adjust the control voltage signals CS1 and CS2 according to the types and the instructions of the dimming command CMD1, so as to adjust the luminosity of each of the lighting module 160 and the lighting module 180 having different color temperatures respectively by adjusting the control voltage signals CS1 and CS2 correspondingly. For example, the lighting module 160 has a first luminosity controlled by the current I1, and the lighting module 180 has a second luminosity controlled by the current I2. The processing circuit 124 may adjust the control voltage signals CS1 and CS2 to control the ratio between the current I1 and the current I2, and thus control the ratio between the first luminosity and the second luminosity, so as to control the color temperature of the mixed light output by the lighting module 160 and the lighting module 180 in the solid state lighting device 100. In addition, the processing circuit 124 may adjust the control voltage signals CS1 and CS2 to control the average value of the current I1 and the current I2 respectively, and thus control the first luminosity and the second luminosity respectively, so as to control the brightness of the mixed light output by the lighting module 160 and the lighting module 180 in the solid state lighting device 100.

For example, the processing circuit 124 may increase the luminosity of the lighting module 160 (e.g., warm light source with lower color temperature) and reduce the luminosity of the lighting module 180 (e.g., cold light source with higher color temperature) to reduce the color temperature of the light output by the solid state device 100 and give a warmer light. On the other hand, the processing circuit 124 may also reduce the luminosity of the lighting module 160 (e.g., warm light source with lower color temperature) and increase the luminosity of the lighting module 180 (e.g., cold light source with higher color temperature) to increase the color temperature of the light output by the solid state device 100 and give a cooler light.

For the ease of explanation, in the following paragraphs, the operation of the processing circuit 124 adjusting the brightness and the color temperature of the solid state lighting device 100 will be discussed in accompanied with FIGS. 4A-4C, FIGS. 5A-5C, and FIGS. 6A-6C. In the present embodiment, the color temperature of the lighting module 160 is about 3000K, and the color temperature of the lighting module 180 is about 6000K.

Figure 4A:
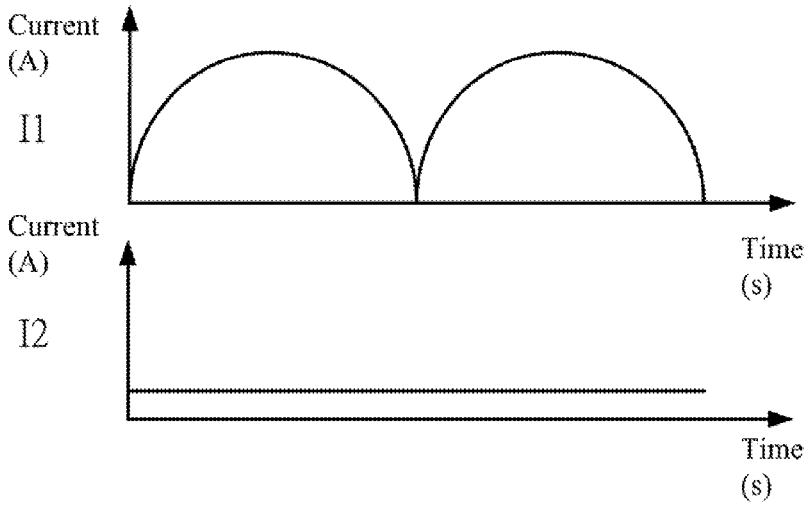
FIGS. 4A-4C are waveform diagrams illustrating the current according to some embodiments of the present disclosure.
Figure 4B:
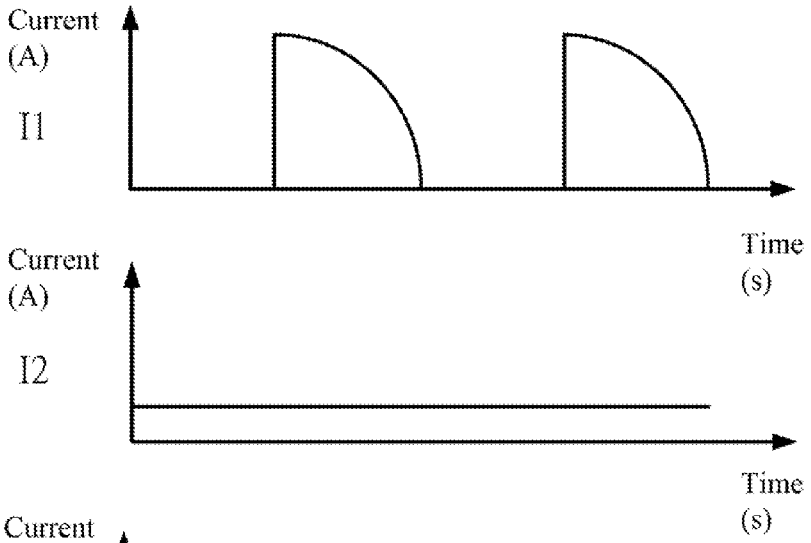
Figure 4C:
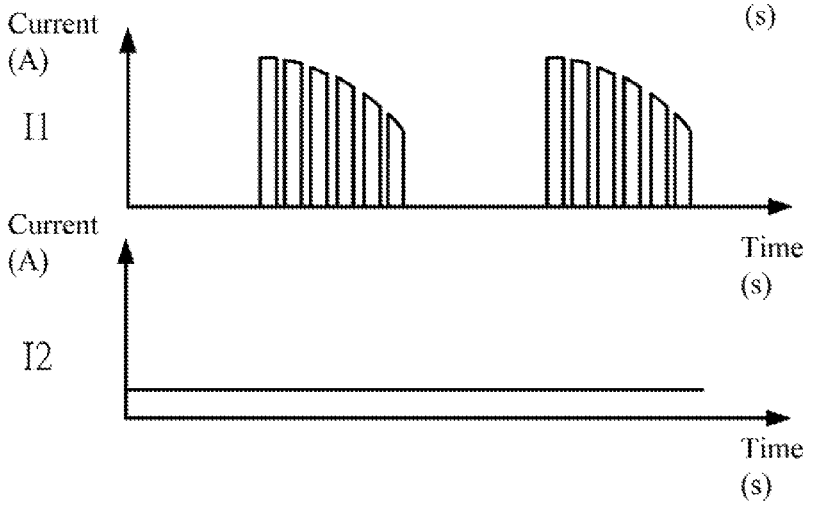

Reference is made to FIGS. 4A-4C. FIGS. 4A-4C are waveform diagrams illustrating the current I1 and the current I2 according to some embodiments of the present disclosure. In some embodiments, in FIGS. 4A-4C, the waveform of the current I1 and current I2 of the solid state lighting device 100 with different brightness outputs when outputting a warm light with the color temperature of about 3000K are illustrated. As shown in the figure, to keep the color temperature of the output of the solid state lighting device 100 at about 3000K, the processing circuit 124 controls the current I2 flowing thorough the lighting module 180 to be zero. Alternatively stated, the output light of the solid state lighting device 100 is all provided by the lighting module 160. In addition, the processing circuit 124 controls the average value of the current I1 flowing through the lighting module 160 to adjust the brightness of the output of the solid state lighting device 100.

As shown in FIG. 4A, when the brightness of the output is 100%, the processing circuit 124 outputs the control voltage signal CS1 as illustrated in the FIG. 3A, such that the control voltage signal CS1 is continuously ON. At this time, the current I1 has the largest average value, and the waveform of the current I1 is the upper half of the sinusoidal wave in each cycle.

As shown in FIG. 4B, when the brightness of the output is 50%, the processing circuit 124 outputs the control voltage signal CS1 as illustrated in the FIG. 3C, such that the current I1 is ON after the phase delay angle d2 (e.g., about 90 degrees). Thus, the average value of the current I1 is 50% of the largest average value, and the brightness of the output is also about 50%.

As shown in FIG. 4C, when the brightness of the output is 25%, the processing circuit 124 outputs the control voltage signal CS1 as illustrated in the FIG. 3D, such that the current I1 is ON after the phase delay angle d2 (e.g., about 90 degrees), and keep the duty cycle at about 50% Thus, the average value of the current I1 is 25% of the largest average value, and the brightness of the output is also about 25%.

Figure 5A:
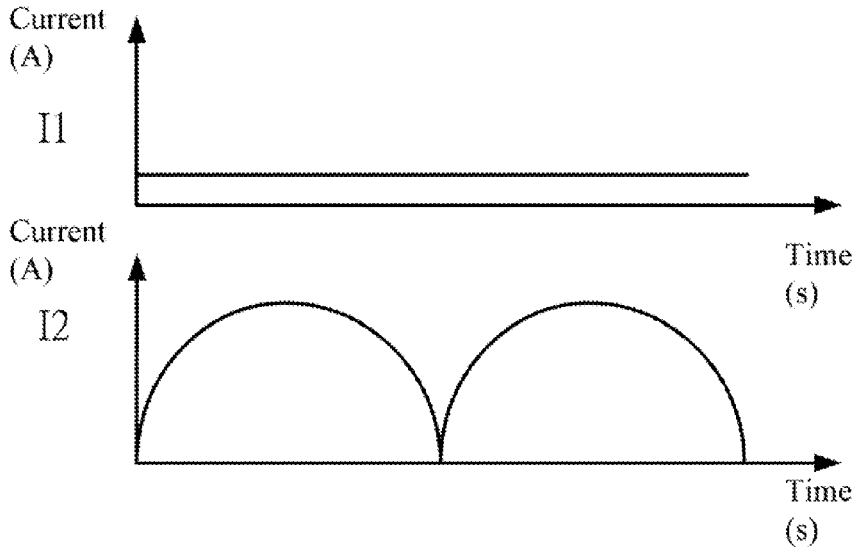
FIGS. 5A-5C are waveform diagrams illustrating the current according to some embodiments of the present disclosure.
Figure 5B:
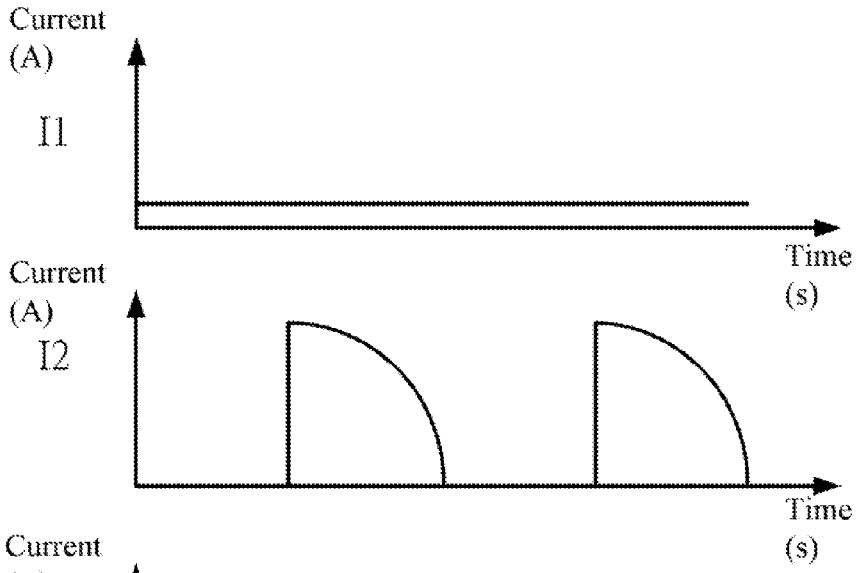
Figure 5C:
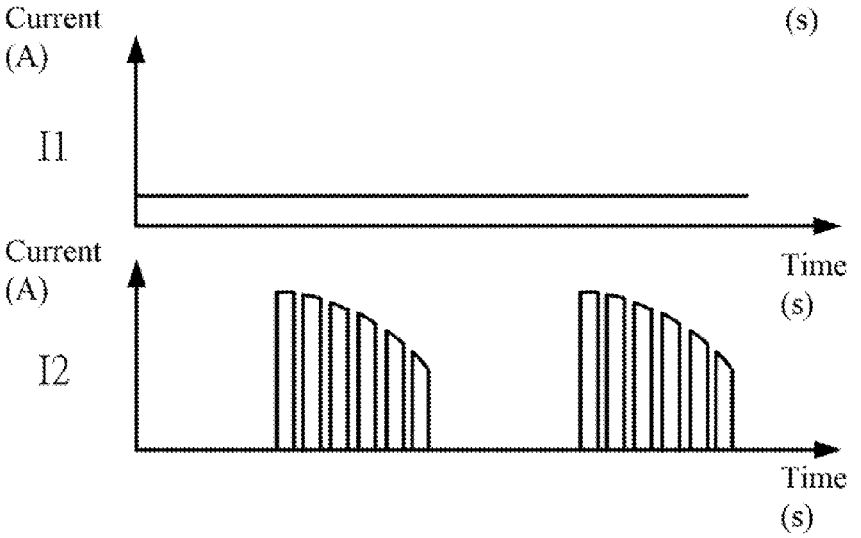

Reference is made to FIGS. 5A-50. FIGS. 5A-5C are waveform diagrams illustrating the current I1 and the current I2 according to some embodiments of the present disclosure. In some embodiments, in FIGS. 5A-5C, the waveform of the current I1 and current I2 of the solid state lighting device 100 with different brightness outputs when outputting a cool light with the color temperature of about 6000K are illustrated. Similar to the FIGS. 4A-4C, to keep the color temperature of the output of the solid state lighting device 100 at about 6000K, the processing circuit 124 controls the current I1 flowing thorough the lighting module 160 to be zero. Alternatively stated, the output light of the solid state lighting device 100 is all provided by the lighting module 180. In addition, the processing circuit 124 controls the average value of the current I2 flowing through the lighting module 180 to adjust the brightness of the output of the solid state lighting device 100.

As shown in FIG. 5A, when the brightness of the output is 100%, the processing circuit 124 outputs the control voltage signal CS2, such that the waveform of the current I2 is the upper half of the sinusoidal wave in each cycle. As shown in FIG. 5B, when the brightness of the output is 50%, the processing circuit 124 outputs the corresponding control voltage signal CS2, such that the current I2 is ON after the phase delay angle d2 (e.g., about 90 degrees). As shown in FIG. 4C, when the brightness of the output is 25%, the processing circuit 124 outputs the corresponding control voltage signal CS2, such that the current I2 is ON after the phase delay angle d2 (e.g., about 90 degrees), and keep the duty cycle at about 50%.

Alternatively stated, compared to FIG. 4A, the average value of the current I2 in FIG. 5A is the same as the average value of the current I1 in FIG. 4A, so the brightness of the output is both about 100%, in which the solid state lighting device 100 in FIG. 4A outputs a warm light with the color temperature of about 3000K, while the solid state lighting device 100 in FIG. 5A outputs a cool light with the color temperature of about 6000K. Similarly, in both FIG. 4B and FIG. 5B, the brightness of the output is both about 50%. In both FIG. 4C and FIG. 5C, the brightness of the output is both about 25%.

Figure 6A:
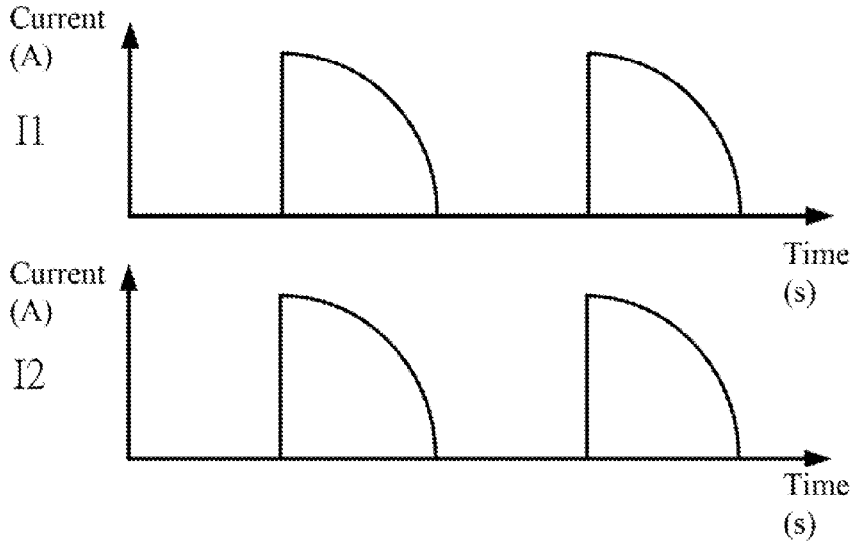
FIGS. 6A-6C are waveform diagrams illustrating the current according to some embodiments of the present disclosure.
Figure 6B:
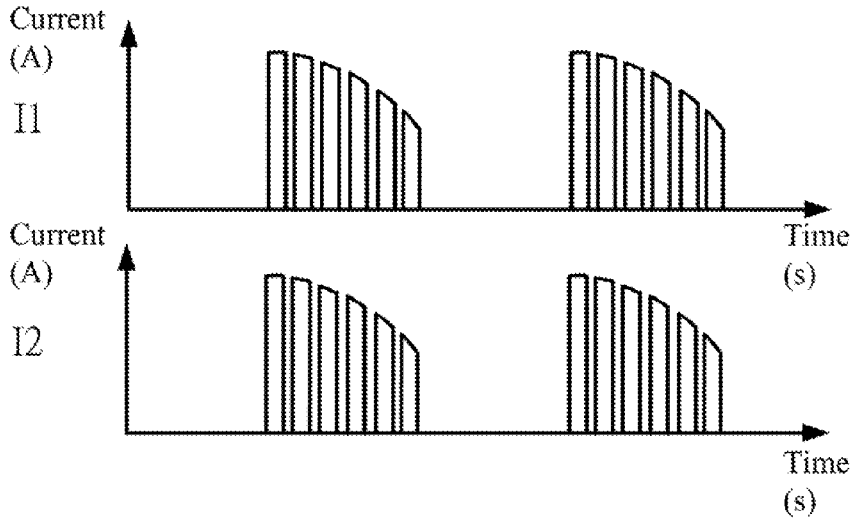
Figure 6C:
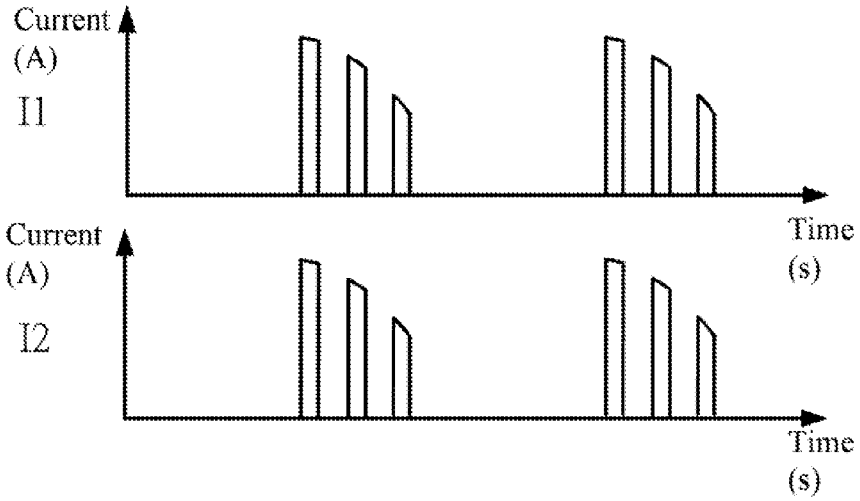

Reference is made to FIGS. 6A-6C. FIGS. 6A-6C are waveform diagrams illustrating the current I1 and the current I2 according to some embodiments of the present disclosure. In some embodiments, in FIGS. 6A-6C, the waveform of the current I1 and current I2 of the solid state lighting device 100 with different brightness outputs when outputting a mixed light with the color temperature within about 3000k-6000K are illustrated.

Compared to the FIGS. 4A-4C and FIGS. 5A-5C, in the FIGS. 6A-6C, the average values of current I1 and I2 are not zero. Alternatively stated, the output light of the solid state lighting device 100 is mixed and obtained by the warm light with the color temperature of about 3000K and the cool light with the color temperature of about 6000K respectively output by the lighting modules 160 and 180. Therefore, the color temperature of the overall output light is the neutral color temperature within about 3000k-6000K. In some embodiments, by adjusting the ratio of the current I1 and I2 properly, the output color temperature of the solid state lighting device 100 may be controlled. In some embodiments, the current I1 and I2 illustrated in the FIGS. 6A-6C are the current waveform flowing through the lighting module 160 and 180 when the solid state lighting device 100 outputs light with the neutral color temperature (e.g., 4500K).

As shown in FIG. 6A, when the brightness of the output is 100%, the processing circuit 124 outputs the corresponding control voltage signal CS1 and CS2, such that the waveform of the current I1 and I2 is ON after the phase delay angle d2 (e.g., about 90 degrees). Therefore, the average value of the current I1 and I2 is about 50% of the largest average value, and thus the brightness of the output for each of the lighting module 160 and 180 is also about 50%. After the additive mixing of the light output by the lighting module 160 and 180, the overall output brightness of the solid state lighting device 100 is 100%, and the output color temperature is the neutral color temperature.

As shown in FIG. 6B, when the brightness of the output is 50%, the processing circuit 124 outputs the corresponding control voltage signal CS1 and CS2, such that the current I1 and I2 is ON after the phase delay angle d2 (e.g., about 90 degrees), and keep the duty cycle at about 50%. Therefore, the average value of the current I1 and I2 is about 25% of the largest average value, and thus the brightness of the output for each of the lighting module 160 and 180 is also about 25%. After the additive mixing of the light output by the lighting module 160 and 180, the overall output brightness of the solid state lighting device 100 is 50%, and the output color temperature is the neutral color temperature.

Similarly, as shown in FIG. 6C, when the brightness of the output is 25%, the processing circuit 124 outputs the corresponding control voltage signal CS1 and CS2, such that the current I1 and I2 is ON after the phase delay angle d2 (e.g., about 90 degrees), and keep the duty cycle at about 25%. Therefore, the average value of the current I1 and I2 is about 12.5% of the largest average value, and thus the brightness of the output for each of the lighting module 160 and 180 is also about 12.5%. After the additive mixing of the light output by the lighting module 160 and 180, the overall output brightness of the solid state lighting device 100 is 25%, and the output color temperature is the neutral color temperature.

It is noted that, in some embodiments, the average value of and the ratio between current I1 and I2 may be freely adjusted so as to control the brightness and the color temperature of the light output by the solid state lighting device 100 according to the dimming command CMD1. The current waveforms illustrated in FIGS. 4A-6C and corresponding color temperature and brightness in the above embodiments are merely examples and not meant to limit the present disclosure. Accordingly, by controlling the current of the lighting modules 160 and 180 with the phase delay angles and the duty cycles at the same time, the brightness output by the lighting modules 160 and 180 may maintain stable, and the flickering issues resulting from the phase delay angle being too large is avoided.

In addition, in some embodiments, the solid state lighting device 100 may further include three or more sets of driving circuits and lighting modules, which are driven by corresponding control voltage signal, to further adjust the brightness, the color temperature or different lighting modes of the output of the solid state lighting module 100. Accordingly, the above embodiments are merely examples, such that the actual numbers of the driving circuits, lighting modules, and the LEDs in the lighting modules in the solid state lighting device 100, the degrees of the phase delay angles (e.g., the time of the trigger delay period), and the duty cycles may be designed based on the practical needs, and the present disclosure is not limited thereto.

It is noted that the switches SW1 and SW2, the rectifying circuit 122, and the LEDs in the lighting modules 160 and 180 in the above embodiments may be implemented in various ways. For example, the switches SW1 and SW2 may be realized by Bipolar Junction Transistors (BJTs), Metal-Oxide-Semiconductor Field-Effect Transistors (MOSFETs) or other proper semiconductor elements.

In addition, in some embodiments, the processing circuit 124 may be realized by a Microcontroller Unit (MCU) in implementation, or by various ways such as a Digital Signal Processor (DSP), a Field-programmable gate array (FPGA), etc.

In summary, in the present disclosure, by applying above-mentioned embodiments, the dimming of the solid state lighting device is achieved by controlling the phase delay angle and the duty cycle of the current. Thus, the convenience and the stability of dimming control are improved, and the adjustment of the brightness and the color temperature for the solid state lighting device is simplified.

Although the disclosure has been described in considerable detail with reference to certain embodiments thereof, it will be understood that the embodiments are not intended to limit the disclosure. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A dimming module, comprising:

a rectifying circuit, configured to convert an ac voltage to a rectified voltage;

a first driving circuit, configured to receive the rectified voltage to provide a first current to drive a first lighting module, wherein the first driving circuit comprises a first switch, and the first switch is configured to be on or off according to a first control voltage signal selectively to control the first current; and a processing circuit, configured to receive a dimming command and adjust the first control voltage signal according to the dimming command, wherein the first control voltage signal is configured to control a phase delay angle of the first current and a duty cycle of the first current;

wherein the processing circuit comprises:

a zero-crossing detecting unit, electrically coupled to the rectifying circuit and configured to detect a zero crossing point of the rectified voltage, such that the first control voltage signal output by the processing circuit is synchronized with the rectified voltage.

2. The dimming module of claim 1, wherein when the luminosity of the first lighting module is configured to be larger than a critical luminosity value, the first control voltage signal is configured to control the phase delay angle of the first current to adjust the luminosity of the first lighting module, and when the luminosity of the first lighting module is configured to be smaller than the critical luminosity value, the first control voltage signal is configured to control the phase delay angle fixed at a critical angle and control the duty cycle to adjust the luminosity of the first lighting module.

3. The dimming module of claim 1, further comprising:

a second driving circuit, configured to receive the rectified voltage to provide a second current to drive a second lighting module, and control the second current according to a second control voltage signal, wherein the first lighting module comprises a first color temperature, and the second lighting module comprises a second color temperature different from the first color temperature;

wherein the processing circuit is further configured to adjust the second control voltage signal according to the dimming command, and the second control voltage signal is configured to control the phase delay angle of the second current and the duty cycle of the second current.

4. The dimming module of claim 3, wherein the processing circuit is configured to control the color temperature of the mixed light output by the first lighting module and the second lighting module by adjusting the first control voltage signal and the second control voltage signal to control the ratio between the first current and the second current, and control the brightness of the mixed light output by the first lighting module and the second lighting module by adjusting the first control voltage signal and the second control voltage signal to respectively control an average value of the first current and of the second current.

5. A solid state lighting device, comprising:

a first lighting module comprising a first color temperature;

a second lighting module comprising a second color temperature different from the first color temperature;

a first driving circuit configured to provide a first current to drive the first lighting module according to a first control voltage signal, wherein the first current is configured to control a first luminosity of the first lighting module;

a second driving circuit configured to provide a second current to drive the second lighting module according to a second control voltage signal, wherein the second current is configured to control a second luminosity of the second lighting module;

a processing circuit, configured to receive a dimming command and adjust the first control voltage signal and the second control voltage signal according to the dimming command, wherein when the first luminosity and the second luminosity are configured to be larger than a critical luminosity value, the first control voltage signal and the second control voltage signal are configured to control a phase delay angle of the first current and of the second current respectively to adjust the first luminosity and the second luminosity; and a rectifying circuit, configured to convert an AC voltage to a rectified voltage;

wherein the processing circuit comprises a zero-crossing detecting unit electrically coupled to the rectifying circuit and configured to detect a zero crossing point of the rectified voltage, such that the first control voltage signal output by the processing circuit is synchronized with the rectified voltage;

wherein the first driving circuit and the second driving circuit are electrically coupled to the rectifying circuit and configured to receive the rectified voltage to provide the first current and the second current respectively.

6. The solid state lighting device of claim 5, wherein the first driving circuit comprises a first switch such that the first switch is selectively turned on or turned off according to the first control voltage signal so as to control the first current, and the second driving circuit comprises a second switch such that the second switch is selectively turned on or turned off according to the second control voltage signal so as to control the second current.

7. The solid state lighting device of claim 5, wherein when the first luminosity and the second luminosity are configured to be smaller than the critical luminosity value, the first control voltage signal and the second control voltage signal are configured to control the phase delay angle of the first current and the second current fixed at a critical angle and control a duty cycle of the first current and the second current to adjust the first luminosity and the second luminosity.

8. The solid state lighting device of claim 5, wherein the processing circuit is configured to control the value of the first luminosity and the second luminosity by adjusting the first control voltage signal and the second control voltage signal to control the brightness of the solid state lighting device, and control the ratio between the first luminosity and the second luminosity to control the color temperature of the solid state lighting device.

* * * * *